US011322869B2

(12) United States Patent
Phillips et al.

(10) Patent No.: US 11,322,869 B2
(45) Date of Patent: May 3, 2022

(54) ELECTRICAL CONNECTOR HAVING A GROUND BUS

(71) Applicant: TE Connectivity Services GmbH, Schaffhausen (CH)

(72) Inventors: Michael John Phillips, Camp Hill, PA (US); Randall Robert Henry, Lebanon, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/877,677

(22) Filed: May 19, 2020

(65) Prior Publication Data

US 2021/0367361 A1 Nov. 25, 2021

(51) Int. Cl.

| | |
|---|---|
| ***H01R 12/71*** | (2011.01) |
| ***H01R 24/62*** | (2011.01) |
| ***H01R 12/72*** | (2011.01) |
| *H01R 13/6596* | (2011.01) |
| *H01R 13/6591* | (2011.01) |
| *H01R 13/6597* | (2011.01) |
| *H01R 13/652* | (2006.01) |
| *H01R 13/6471* | (2011.01) |

(52) U.S. Cl.

CPC ..... *H01R 12/712* (2013.01); *H01R 12/727* (2013.01); *H01R 24/62* (2013.01); *H01R 12/714* (2013.01); *H01R 13/6471* (2013.01); *H01R 13/652* (2013.01); *H01R 13/6591* (2013.01); *H01R 13/6596* (2013.01); *H01R 13/6597* (2013.01); *H01R 13/65914* (2020.08)

(58) Field of Classification Search

CPC .... H01R 12/712; H01R 12/727; H01R 24/62; H01R 13/6597; H01R 13/652; H01R 13/65914; H01R 13/6596; H01R 13/6471; H01R 13/6591; H01R 12/714

See application file for complete search history.

(56) References Cited

U.S. PATENT DOCUMENTS

| | | | | |
|---|---|---|---|---|
| 9,496,657 | B1 * | 11/2016 | Chang | H01R 13/6597 |
| 9,692,183 | B2 * | 6/2017 | Phillips | H01R 13/6471 |

* cited by examiner

*Primary Examiner* — Abdullah A Riyami
*Assistant Examiner* — Justin M Kratt

(57) ABSTRACT

A contact assembly includes a contact array having contacts including signal contacts and ground contacts. The signal contacts include signal intermediate portions extending between signal mating beams and signal contact tails. The ground contacts include ground intermediate portions extending between ground mating beams and ground contact tails. The contact assembly includes front and rear contact holders. The contact assembly includes a ground bus bridge extending between each of the ground contacts to electrically common each of the ground contacts. The ground bus bridge is integral with the ground contacts and extends across the signal intermediate portions in close proximity to the signal intermediate portions for resonance control of signals transmitted along the signal contacts.

18 Claims, 7 Drawing Sheets

ELECTRICAL CONNECTOR HAVING A GROUND BUS

BACKGROUND OF THE INVENTION

The subject matter herein relates generally to electrical connectors of communication systems.

Some communication systems utilize communication connectors, such as card edge connectors to interconnect various components of the system for data communication. Some known communication systems use pluggable modules, such as I/O modules or circuit cards, which are electrically connected to the card edge connectors. The pluggable modules have module circuit cards having card edges that are mated with the card edge connectors during the mating operation. Each card edge connector typically has an upper row of contacts and a lower row of contact for mating with the corresponding circuit board. There is a need for electrical connectors and circuit boards of communication systems to have greater contact density and/or data throughput. However, as contact density and data throughput are increased, electrical performance is negatively affected. For instance, the signal lines suffer from cross-talk.

Known electrical connectors include a ground shielding structure to provide electrical shielding for the signal lines. For example, ground shields may be connected to the ground contacts to provide electrical shielding. Such ground shields are typically soldered or welded to the ground contacts. The ground shields are stamped and formed parts and increase manufacturing costs and assembly costs of the electrical connector. Additionally, the solder interfaces between the ground shield and the ground contacts can be inconsistent and subject to failure as a result of mechanical or temperature stresses.

A need remains for a reliable electrical connector.

BRIEF DESCRIPTION OF THE INVENTION

In embodiments herein, a contact assembly for an electrical connector is provided. The contact assembly includes a contact array having contacts including signal contacts and ground contacts. The signal contacts include signal intermediate portions extending between signal mating beams configured to mate with mating contacts and signal contact tails configured to be mounted to a host circuit board. The ground contacts include ground intermediate portions extending between ground mating beams configured to mate with mating contacts and ground contact tails configured to be mounted to the host circuit board. The contact assembly includes an front contact holder holding the signal mating beams and the ground mating beams and an rear contact holder separate and discrete from the front contact holder holding the signal contact tails and the ground contact tails. The contact assembly includes a ground bus bridge extending between each of the ground contacts to electrically common each of the ground contacts. The ground bus bridge is integral with the ground contacts. The ground bus bridge extends across the signal intermediate portions in close proximity to the signal intermediate portions for resonance control of signals transmitted along the signal contacts.

In another embodiment, a contact assembly for an electrical connector is provided. The contact assembly includes an upper contact array and a lower contact array held by a contact positioner to receive a card edge of a circuit card therebetween. The upper contact array includes a first upper contact array and a second upper contact array. The first upper contact array includes first upper contacts, a first upper front contact holder, and a first upper rear contact holder. The first upper rear contact holder is separate and discrete from the first upper front contact holder. The first upper contacts include first upper intermediate portions extending between first upper mating beams and first upper contact tails. The first upper mating beams extend from the first upper front contact holder and are arranged in a first upper row to mate with first upper mating contacts of the circuit card. The first upper contact tails extend from the first upper rear contact holder for mounting to a host circuit board. The first upper contacts include first upper signal contacts and first upper ground contacts. The first upper contact array includes a first upper ground bus bridge extending between each of the first upper ground contacts to electrically common each of the first upper ground contacts. The first upper ground bus bridge is integral with the first upper ground contacts. The first upper ground bus bridge extends across the first upper intermediate portions of the first upper signal contacts in close proximity to the first upper intermediate portions of the first upper signal contacts for resonance control of signals transmitted along the first upper signal contacts. The second upper contact array includes second upper contacts, a second upper front contact holder, and a second upper rear contact holder. The second upper rear contact holder is separate and discrete from the second upper front contact holder. The second upper contacts includes second upper intermediate portions extending between second upper mating beams and second upper contact tails. The second upper mating beams extending from the second upper front contact holder and arranged in a second upper row to mate with second upper mating contacts of the circuit card. The second upper contact tails extends from the second upper rear contact holder for mounting to the host circuit board. The second upper contacts include second upper signal contacts and second upper ground contacts. The second upper contact array includes a second upper ground bus bridge extending between each of the second upper ground contacts to electrically common each of the second upper ground contacts. The second upper ground bus bridge is integral with the second upper ground contacts. The second upper ground bus bridge extends across the second upper intermediate portions of the second upper signal contacts in close proximity to the second upper intermediate portions of the second upper signal contacts for resonance control of signals transmitted along the second upper signal contacts.

In another embodiment, a card edge connector for mating with a pluggable module is provided. The card edge includes a housing including a top and a bottom. The housing has a front and a rear. The housing has a first side and a second side. The bottom is configured to be mounted to a host circuit board. The housing includes a cavity and a housing card slot open to the cavity at the front of the housing. The housing card slot is configured to receive a card edge of a module circuit board of the pluggable module. The card edge includes a contact assembly received in the cavity. The contact assembly has a contact positioner holding upper contacts in an upper contact array and lower contacts in a lower contact array. The contact positioner has a base wall between the upper contact array and the lower contact array. The upper contacts include upper signal contacts and upper ground contacts. The upper signal contacts include upper signal intermediate portions extending between upper signal mating beams and upper signal contact tails. The upper signal mating beams are configured to extend into the housing card slot to mate with upper mating contacts of the module circuit board. The upper signal contact tails extend from the contact positioner for mounting to the host circuit board. The upper ground contacts include upper ground intermediate portions extending between upper ground mating beams and upper ground contact tails. The upper ground mating beams are configured to extend into the housing card slot to mate with upper mating contacts of the module circuit board. The upper ground contact tails extend from the contact positioner for mounting to the host circuit board. The upper contact array include an upper front contact holder holding the upper signal mating beams and the upper ground mating beams and the upper contact array including an upper rear contact holder separate and discrete from the upper front contact holder holding the upper signal contact tails and the upper ground contact tails. The upper contact array includes a ground bus bridge extending between each of the ground contacts to electrically common each of the ground contacts. The ground bus bridge is integral with the ground contacts. The ground bus bridge extends across the upper signal intermediate portions in close proximity to the upper signal intermediate portions for resonance control of signals transmitted along the upper signal contacts.

DETAILED DESCRIPTION OF THE INVENTION

Figure 1:
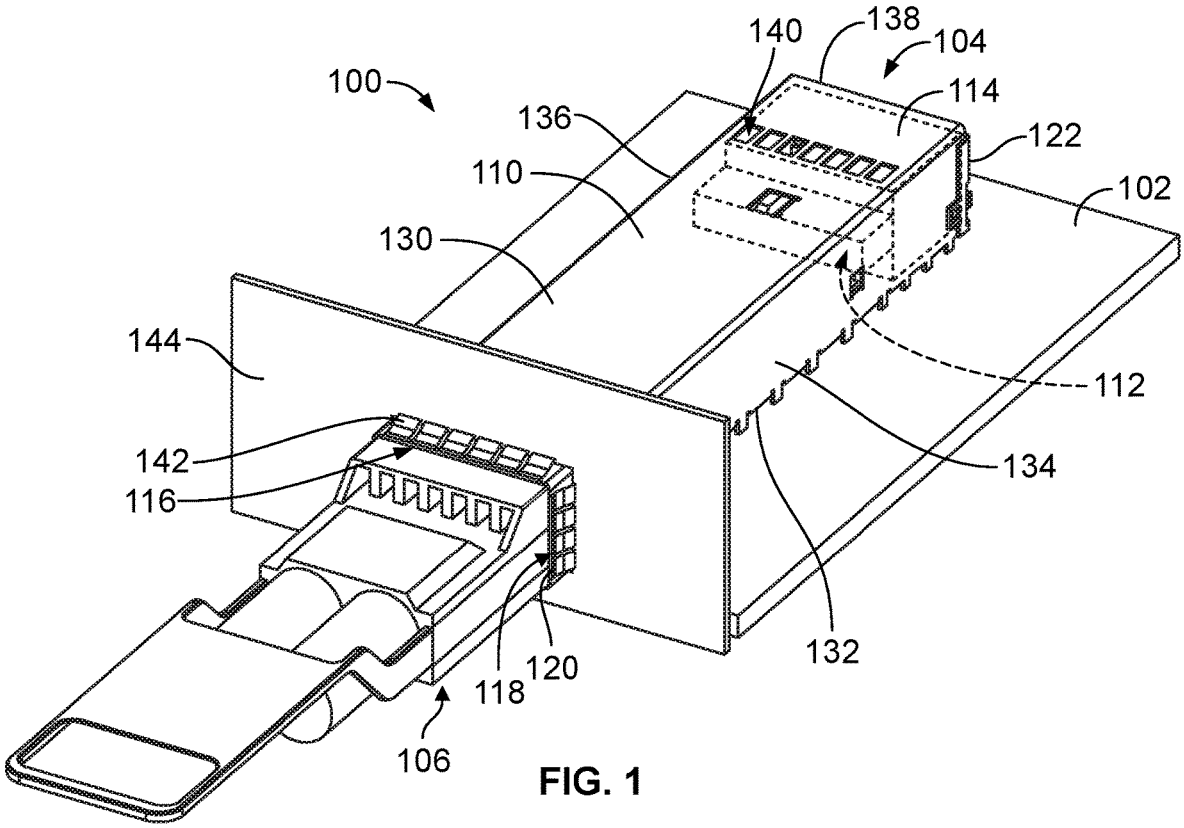
FIG. 1 is a front perspective view of a communication system formed in accordance with an exemplary embodiment.

FIG. 1 is a front perspective view of a communication system 100 formed in accordance with an exemplary embodiment. The communication system includes a host circuit board 102 and an electrical connector 112 coupled to the host circuit board 102. In various embodiments, the electrical connector 112 may be part of a receptacle connector assembly 104 mounted to the host circuit board 102. The electrical connector 112 is configured to be electrically connected with a mating electrical connector 106. In the illustrated embodiment, the mating electrical connector 106 is a pluggable module and may be referred to thereinafter as pluggable module 106. The pluggable module 106 is fully shown in FIG. 2. The pluggable module 106 is electrically connected to the host circuit board 102 through the receptacle connector assembly 104.

In an exemplary embodiment, the receptacle connector assembly 104 includes a receptacle cage 110 and the card edge connector 112 (shown with phantom lines) adjacent the receptacle cage 110. For example, in the illustrated embodiment, the card edge connector 112 is received in the receptacle cage 110. In other various embodiments, the card edge connector 112 may be located rearward of the receptacle cage 110. In various embodiments, the receptacle cage 110 is enclosed and provides electrical shielding for the card edge connector 112. The pluggable module 106 is loaded into the receptacle cage 110 and is at least partially surrounded by the receptacle cage 110. In an exemplary embodiment, the receptacle cage 110 is a shielding, stamped and formed cage member that includes a plurality of shielding walls 114 that define one or more module channels for receipt of corresponding pluggable modules 106. In other embodiments, the receptacle cage 110 may be open between frame members to provide cooling airflow for the pluggable modules 106 with the frame members of the receptacle cage 110 defining guide tracks for guiding loading of the pluggable modules 106 into the receptacle cage 110. In other various embodiments, the receptacle connector assembly 104 may be provided without the receptacle cage 110, rather only including the card edge connector 112. In the illustrated embodiment, the card edge connector 112 is oriented for horizontal mating (for example, parallel to the host circuit board 102). In other various embodiments, the card edge connector 112 is oriented for vertical mating (for example, perpendicular to the host circuit board 102).

In the illustrated embodiment, the receptacle cage 110 is a single port receptacle cage configured to receive a single pluggable module 106. In other various embodiments, the receptacle cage 110 may be a ganged cage member having a plurality of ports ganged together in a single row and/or a stacked cage member having multiple ports stacked as an upper port and a lower port. The receptacle cage 110 includes a module channel 116 having a module port 118 open to the module channel 116. The module channel 116 receives the pluggable module 106 through the module port 118. In an exemplary embodiment, the receptacle cage 110 extends between a front end 120 and a rear end 122. The module port 118 is provided at the front end 120. Any number of module channels 116 may be provided in various embodiments arranged in a single column or in multiple columns (for example, 2×2, 3×2, 4×2, 4×3, 4×1, 2×1, and the like). Optionally, multiple card edge connectors 112 may be arranged within the receptacle cage 110, such as when multiple rows and/or columns of module channels 116 are provided.

In an exemplary embodiment, the walls 114 of the receptacle cage 110 include a top wall 130, a bottom wall 132, a first side wall 134 and a second side wall 136 extending from the top wall 130. The bottom wall 132 may rest on the host circuit board 102. In other various embodiments, the receptacle cage 110 may be provided without the bottom wall 132. Optionally, the walls 114 of the receptacle cage 110 may include a rear wall 138 at the rear end 122. The walls 114 define a cavity 140. For example, the cavity 140 may be defined by the top wall 130, the bottom wall 132, the side walls 134, 136 and the rear wall 138. The cavity 140 includes the module channel 116. In various embodiments, the cavity 140 receives the card edge connector 112, such as at the rear end 122. Other walls 114 may separate or divide the cavity 140 into additional module channels 116, such as in embodiments using ganged and/or stacked receptacle cages. For example, the walls 114 may include one or more vertical divider walls between ganged module channels 116. In various embodiments, the walls 114 may include a separator panel between stacked upper and lower module channels 116. The separator panel may include an upper panel and a lower panel that form a space between the upper and lower module channels 116, such as for airflow, for a heat sink, for routing light pipes, or for other purposes.

In an exemplary embodiment, the receptacle cage 110 may include one or more gaskets 142 at the front end 120 for providing electrical shielding for the module channels 116. For example, the gaskets 142 may be provided at the port 118 to electrically connect with the pluggable modules 106 received in the module channel 116. Optionally, the pluggable module 106 may include a gasket that engages the receptacle cage 110 rather than the receptacle cage 110 having a gasket that engages the pluggable module 106. In an exemplary embodiment, the gaskets 142 may be provided around the exterior of the receptacle cage 110 for interfacing with a panel 144, such as when the front end 120 of the receptacle cage 110 extends through a cutout in the panel 144. The gaskets 142 may include fingers or other deflectable features that are configured to be spring biased against the panel to create an electrical connection with the panel.

Optionally, the receptacle connector assembly 104 may include one or more heat sinks (not shown) for dissipating heat from the pluggable modules 106. For example, the heat sink may be coupled to the top wall 130 for engaging the pluggable module 106 received in the module channel 116. The heat sink may extend through an opening in the top wall 130 to directly engage the pluggable module 106. Other types of heat sinks may be provided in alternative embodiments.

In an exemplary embodiment, the card edge connector 112 is received in the cavity 140, such as proximate to the rear wall 138. However, in alternative embodiments, the card edge connector 112 may be located behind the rear wall 138 exterior of the receptacle cage 110 and extend into the cavity 140 to interface with the pluggable module(s) 106. In an exemplary embodiment, a single card edge connector 112 is provided. In alternative embodiments, the communication system 100 may include multiple card edge connectors 112 (for example, for stacked and/or ganged receptacle cages) for mating with corresponding pluggable modules 106.

In an exemplary embodiment, the pluggable modules 106 are loaded through the port 118 at the front end 120 to mate with the card edge connector 112. The shielding walls 114 of the receptacle cage 110 provide electrical shielding around the card edge connector 112 and the pluggable module 106, such as around the mating interface between the card edge connector 112 and the pluggable module 106.

Figure 2:
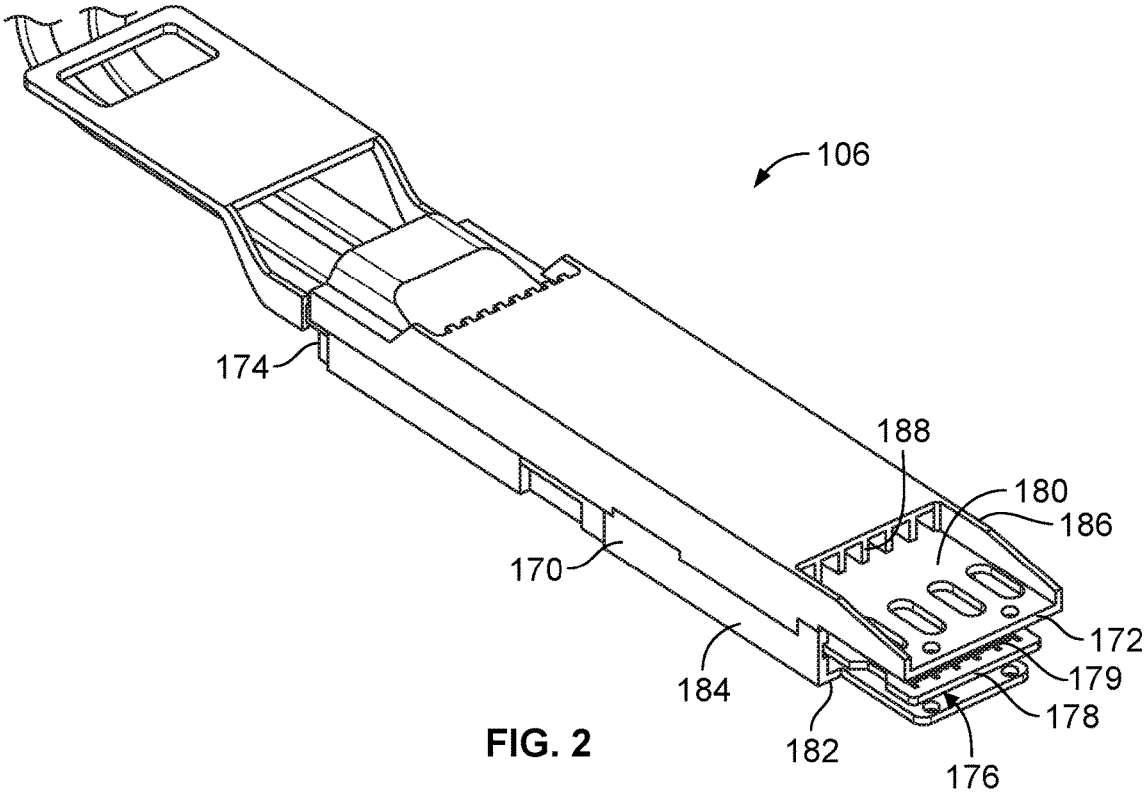
FIG. 2 is a rear perspective view of the pluggable module in accordance with an exemplary embodiment.

FIG. 2 is a rear perspective view of the pluggable module 106 in accordance with an exemplary embodiment. The pluggable module 106 has a pluggable body 170, which may be defined by one or more shells. The pluggable body 170 may be thermally conductive and/or may be electrically conductive, such as to provide EMI shielding for the pluggable module 106. The pluggable body 170 includes a mating end 172 and an opposite front end 174. The mating end 172 is configured to be inserted into the corresponding module channel 116 (shown in FIG. 1). The front end 174 may be a cable end having a cable extending therefrom to another component within the system.

The pluggable module 106 includes a module circuit board 176 that is configured to be communicatively coupled to the card edge connector 112 (shown in FIG. 1). The module circuit board 176 may be accessible at the mating end 172. The module circuit board 176 has a card edge 178 extending between a first or upper surface and a second or lower surface at a mating end of the module circuit board 176. The module circuit board 176 includes mating contacts 179, such as pads or circuits, at the card edge 178 configured to be mated with the card edge connector 112. In an exemplary embodiment, the mating contacts 179 are provided on the upper surface and the lower surface. The module circuit board 176 may include components, circuits and the like used for operating and or using the pluggable module 106. For example, the module circuit board 176 may have conductors, traces, pads, electronics, sensors, controllers, switches, inputs, outputs, and the like associated with the module circuit board 176, which may be mounted to the module circuit board 176, to form various circuits.

The pluggable module 106 includes an outer perimeter defining an exterior of the pluggable body 170. For example, the outer perimeter may be defined by a top 180, a bottom 182, a first side 184 and a second side 186. The pluggable body 170 may have other shapes in alternative embodiments. In an exemplary embodiment, the pluggable body 170 provides heat transfer for the module circuit board 176, such as for the electronic components on the module circuit board 176. For example, the module circuit board 176 is in thermal communication with the pluggable body 170 and the pluggable body 170 transfers heat from the module circuit board 176. Optionally, the pluggable body 170 may include a plurality of heat transfer fins 188 along at least a portion of the outer perimeter, such as the top 180, of the pluggable module 106 for dissipating heat from the pluggable body 170.

In other various embodiments, the pluggable module 106 may be a circuit card rather than an I/O module. For example, the pluggable module 106 may include the module circuit board 176 without the pluggable body 170 surrounding the module circuit board 176.

Figure 3:
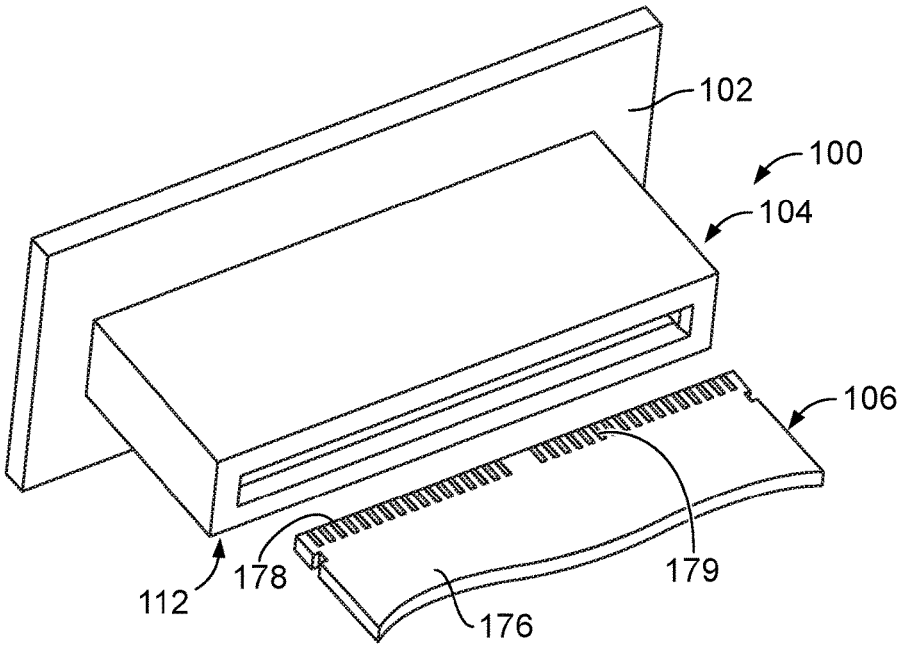
FIG. 3 is a front perspective view of the communication system in accordance with an exemplary embodiment.

FIG. 3 is a front perspective view of the communication system 100 in accordance with an exemplary embodiment. The receptacle connector assembly 104 is shown as a card edge connector 112 mounted to the host circuit board 102 (without a receptacle cage). The card edge connector 112 may be mounted horizontally or vertically in various embodiments. The card edge connector 112 may be mounted to the circuit board 102 to receive the pluggable module 106 in a direction perpendicular to the circuit board 102 in various embodiments. In alternative embodiments, the card edge connector 112 may be a right-angle card edge connector mounted to the circuit board 102 to receive the pluggable module 106 in a direction parallel to the circuit board 102. In the illustrated embodiment, the receptacle connector assembly 104 is a pass-through connector having the mating end and the mounting end of the housing parallel to each other rather than perpendicular to each other such that the contacts pass straight through the housing rather than being right angle contacts.

In the illustrated embodiment, the pluggable module 106 includes the module circuit board 176 without the outer pluggable body (shown in FIG. 2) holding the module circuit board 176. The module circuit board 176 includes the card edge 178 between a first or upper surface and a second or lower surface at a mating end of the module circuit board 176. The module circuit board 176 includes the mating contacts 179 at the card edge 178, such as at both the upper surface and the lower surface, configured to be mated with the contacts of the card edge connector 112.

Figure 4:
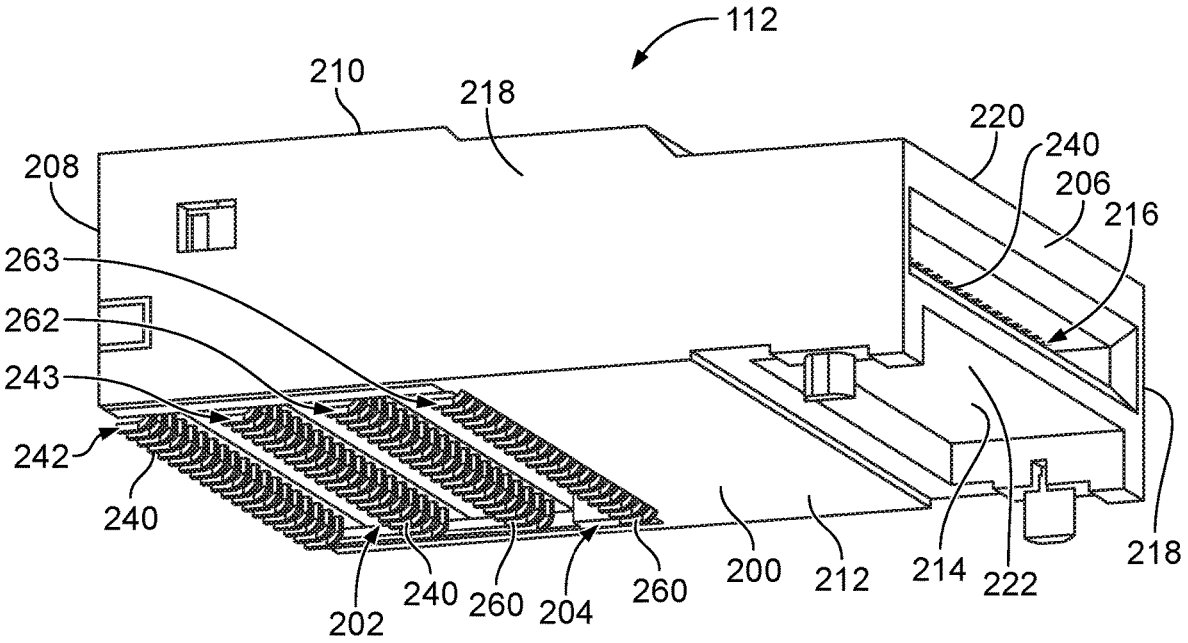
FIG. 4 is a bottom perspective view of the card edge connector in accordance with an exemplary embodiment.
Figure 5:
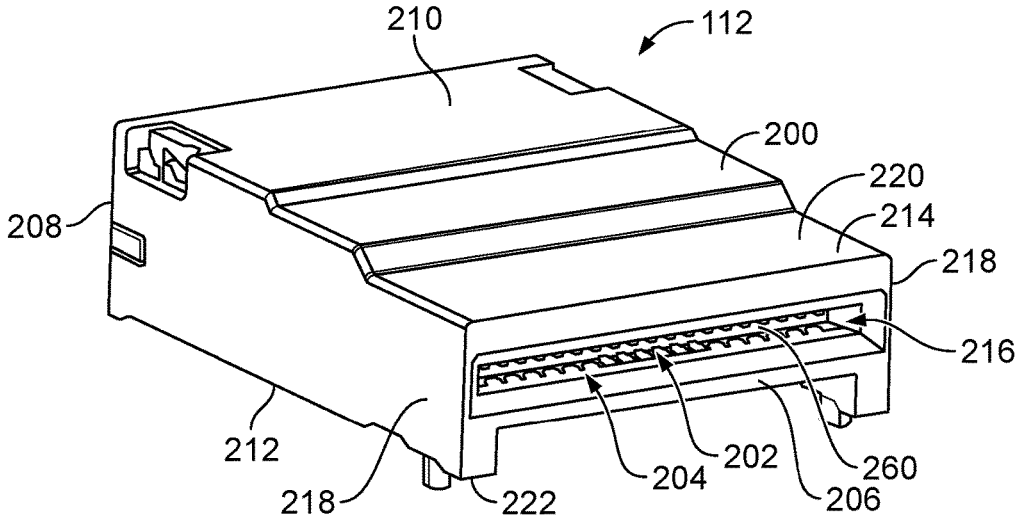
FIG. 5 is a front perspective view of the card edge connector in accordance with an exemplary embodiment.

FIG. 4 is a bottom perspective view of the card edge connector 112 in accordance with an exemplary embodiment. FIG. 5 is a front perspective view of the card edge connector 112 in accordance with an exemplary embodiment. The card edge connector 112 includes an outer housing 200 and a contact assembly 202 received in a cavity 204 of the outer housing 200. The outer housing 200 extends between a front 206 and a rear 208. The outer housing 200 extends between a top 210 and a bottom 212. The outer housing 200 extends between opposite sides 218. The outer housing 200 may be generally box shaped in various embodiments. In the illustrated embodiment, the bottom 212 defines a mounting end configured to be mounted to the host circuit board 102 (shown in FIG. 1) and the front 206 defines the mating end configured to be mated with the pluggable module 106 (shown in FIG. 1). Other orientations are possible in alternative embodiments.

The outer housing 200 includes a top wall 220 at the top 210 and a bottom wall 222 at the bottom 212. In the illustrated embodiment, the outer housing 200 includes a shroud 214 at the front 206 configured to be mated with the pluggable module 106. The shroud 214 is configured to be received in the pluggable module 106. The outer housing 200 includes a housing card slot 216 at the front 206. For example, the housing card slot 216 may be located in the shroud 214 and open at the front of the shroud 214. The housing card slot 216 receives the card edge 178 (shown in FIG. 2) of the module circuit board 176 (shown in FIG. 2).

Contacts of the contact assembly 202 are positioned in the housing card slot 216 for mating with the module circuit board 176, such as to contacts (for example, contact pads) at an upper surface and a lower surface of the module circuit board 176. In an exemplary embodiment, the contact assembly 202 is a double-sided, multi-row contact assembly. For example, the contact assembly 202 includes upper contacts 240 and lower contacts 260 arranged on opposite sides of the card slot. The upper contacts 240 are arranged in one or more upper contact arrays and the lower contacts 260 are arranged in one or more lower contact arrays. In various embodiments, the upper contacts 240 are arranged in multiple rows and the lower contacts 260 are arranged in multiple rows. For example, with reference to FIG. 4, the upper contacts 240 may be arranged in a first upper contact array 242 (e.g., a forward upper contact array) and a second upper contact array 243 (e.g., a rearward upper contact array) and the lower contacts 260 may be arranged in a first lower contact array 262 (e.g., a forward lower contact array) and a second lower contact array 263 (e.g., a rearward lower contact array). As such, the card edge connector 112 has high density and significant data throughput.

Figure 6:
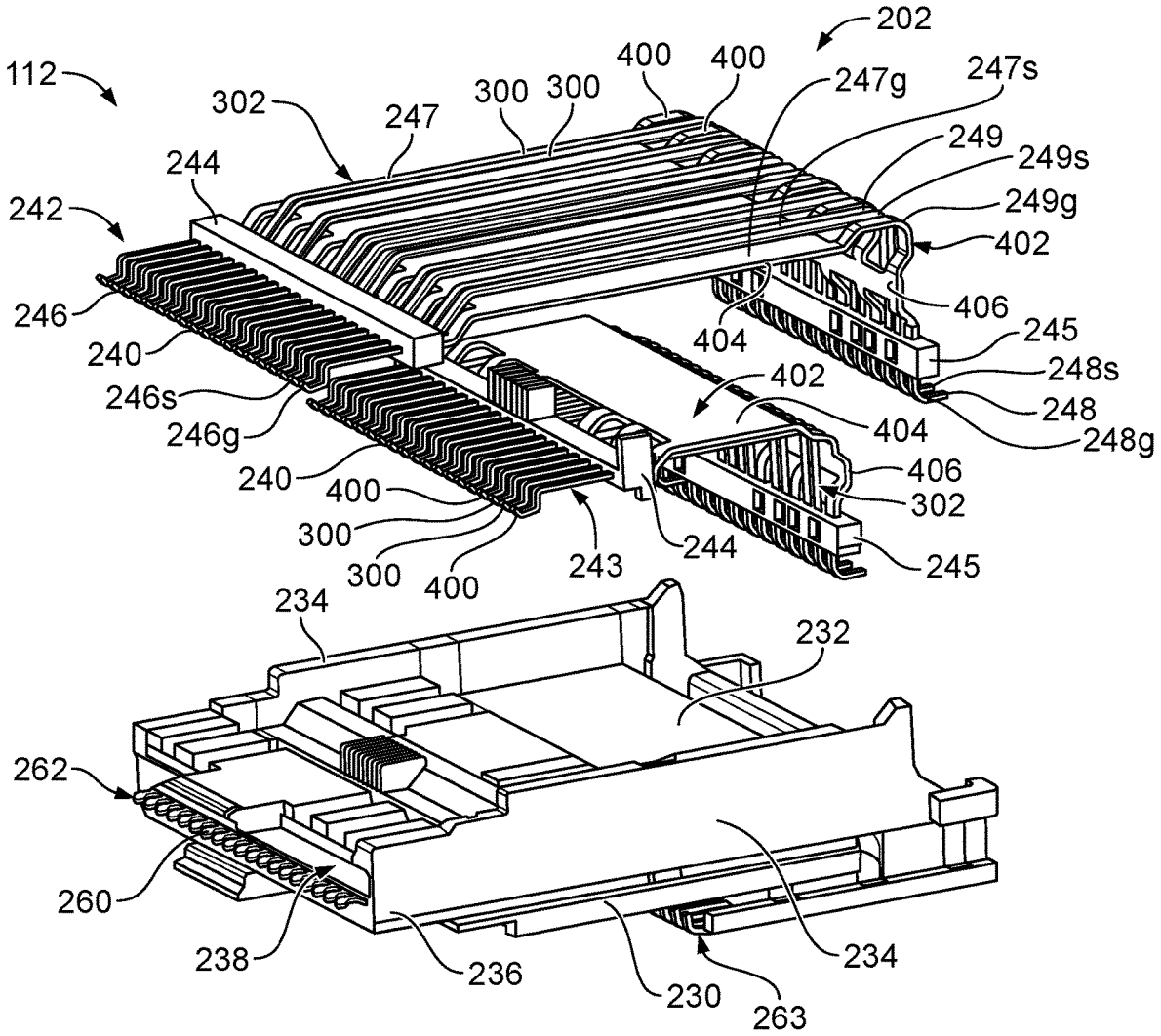
FIG. 6 is an exploded view of a portion of the card edge connector showing the contact assembly in accordance with an exemplary embodiment.

FIG. 6 is an exploded view of a portion of the card edge connector 112 showing the contact assembly 202 in accordance with an exemplary embodiment. FIG. 6 shows the upper contact arrays 242, 243 exploded from a contact positioner 230 of the contact assembly 202. The lower contact arrays 262, 263 are assembled with the contact positioner 230. The contact positioner 230 supports the upper contacts 240 and the lower contacts 260.

The upper contact arrays 242, 243 may be leadframes having stamped and formed contacts forming the upper contacts 240. The mating ends of the upper contacts 240 of the first upper contact array 242 are arranged in a first upper row and the mating ends of the upper contacts 240 of the second upper contact array 243 are arranged in a second upper row parallel to and spaced apart from the first upper row. The mounting ends of the upper contacts 240 of the first upper contact array 242 are arranged in a first row and the mounting ends of the upper contacts 240 of the second upper contact array 243 are arranged in a second row parallel to and spaced apart from the first row. In alternative embodiments, the contact assembly 202 may be provided with a single upper contact array rather than the pair of upper contact arrays 242, 243.

In an exemplary embodiment, the lower contacts 260 are arranged in a first lower contact array 262 and a second lower contact array 263. The lower contact arrays 262, 263 may be leadframes having stamped and formed contacts forming the lower contacts 260. The mating ends of the lower contacts 260 of the first lower contact array 262 are arranged in a first lower row and the mating ends of the lower contacts 260 of the second lower contact array 263 are arranged in a second lower row parallel to and spaced apart from the first lower row. The mounting ends of the lower contacts 260 of the first lower contact array 262 are arranged in a first row and the mounting ends of the lower contacts 260 of the second lower contact array 263 are arranged in a second row parallel to and spaced apart from the first row. In alternative embodiments, the contact array 202 may be provided with a single lower contact array rather than the pair of lower contact arrays 262, 263.

The contact positioner 230 is used to position the upper and lower contacts 240, 260 relative to each other. The contact positioner 230 is used to hold the contact arrays for loading the contact assembly 202 into the outer housing 200. In an exemplary embodiment, the contact positioner 230 is a right-angle contact positioner having a mating end at a front of the contact positioner 230 and a mounting end at a bottom of the contact positioner 230. In an exemplary embodiment, the contacts 240, 260 are movable relative to the contact positioner 230 for proper alignment and positioning for mating with the pluggable module 106 and mounting to the host circuit board 102. In various embodiments, the outer housing 200 is used to properly position the contacts 240, 260.

In an exemplary embodiment, the upper contacts 240 are held by contact holders. For example, the contact arrays 242, 243 may each include a front contact holder 244 and/or a rear contact holder 245. The front contact holder 244 is positioned proximate to front ends of the upper contacts 240. The rear contact holder 245 is positioned proximate to rear ends of the upper contacts 240. The contact holders 244, 245 encase portions of the contacts 240. In various embodiments, the contact holders 244, 245 are dielectric bodies, such as overmold bodies that are overmolded around portions of the contacts 240, to hold the relative positions of the front and rear ends of the contacts 240, such as for loading the contacts 240 into the contact positioner 230. In an exemplary embodiment, the front and rear contact holders 244, 245 are spaced apart from each other. For example, sections of the contacts 240 extend, un-encased, between the contact holders 244, 245. The contacts 240 are independently and freely movable between the contact holders 244, 245. For example, portions of the contacts 240, 260 may be flexed, compressed, shifted, or otherwise moved relative to each other to position the mating ends and the mounting ends within the contact positioner 230.

The contact positioner 230 includes a base 232, arms 234 extending from the base 232 and a nose 236 between the arms 234. The contact positioner 230 has a positioner card slot 238 in the nose 236. The positioner card slot 238 receives the card edge 178 of the module circuit board 176 (shown in FIG. 2). The base 232 is located between the upper contacts 240 and the lower contacts 260. The base 232 may hold the upper and lower contacts 240, 260. The contact holders 244, 245 may be coupled to the base 232 and/or the arms 234. The nose 236 holds the upper and lower contacts 240, 260. The upper and lower contacts 240, 260 are loaded into the base 232 and into the nose 236 to position the upper and lower contacts 240, 260 for mating with the module circuit board 176 and for mounting to the host circuit board 102 (shown in FIG. 1).

Each upper contact 240 includes a transition portion 247 extending between a mating beam 246 at a mating end and a contact tail 248 at a terminating end. The front contact holder 244 supports the mating beams 246 of the upper contacts 240. For example, the front contact holder 244 is provided at the mating beams 246 and/or the transition portions 247. Optionally, portions of the mating beams 246 and/or front portions of the transition portions 247 may be encased in the front contact holder 244. The mating beams 246 extend forward of the front contact holder 244 for mating with the module circuit board 176. The mating beams 246 are configured to be coupled to the nose 236. The mating beams 246 may extend into the shroud 214 for mating with the module circuit board 176.

The rear contact holder 245 supports the contact tails 248 of the upper contacts 240. For example, the rear contact holder 245 is provided at the contact tails 248 and/or the transition portions 247. Optionally, portions of the contact tails 248 and/or rear portions of the transition portions 247 may be encased in the rear contact holder 245. The contact tails 248 extend from the rear contact holder 245 for termination to the host circuit board 102. For example, the contact tails 248 may be solder tails configured to be soldered to the host circuit board 102. The contact tails 248 may be coupled to the base 232.

In an exemplary embodiment, each upper contact 240 includes an intermediate portion 249 extending between the front contact holder 244 and the rear contact holder 245. The intermediate portion 249 is the un-encased section of the transition portion 247. The intermediate portions 249 may be bent along various sections to transition between the front and rear contact holders 244, 245.

Various upper contacts 240 may be signal contacts 300 and other upper contacts 240 may be ground contacts 400, such as interspersed between signal contacts 300 or pairs of signal contacts 300. The signal contacts 300 are formed by a signal leadframe 302 and the ground contacts 400 are formed by a ground leadframe 402. The signal contacts 300 each include a mating beam 246*s*, a transition portion 247*s*, and a contact tail 248*s*. In an exemplary embodiment, the signal transition portions 247*s* include signal intermediate portions 249*s*. The ground contacts 400 each include a mating beam 246*g*, a transition portion 247*g*, and a contact tail 248*g*. In an exemplary embodiment, the ground transition portions 247*g* include intermediate portions 249*g* and at least one ground bus bridge extending between each of the ground contacts 400 to electrically common each of the ground contacts 400. The ground bus bridge(s) are integral with the ground contacts 400, such as being stamped and formed with the ground contacts 400 as part of the ground leadframe 402. In the illustrated embodiment, the ground leadframe 402 includes a front ground bus bridge 404 proximate to the front of the ground leadframe 402 (for example, proximate to the front contact holder 244) and a rear ground bus bridge 406 proximate to the rear of the ground leadframe 402 (for example, proximate to the rear contact holder 245). For example, the front ground bus bridge 404 is located proximate to the ground mating beams 246*g* and the rear ground bus bridge 406 is located proximate to the ground contact tails 248*g*.

Figure 7:
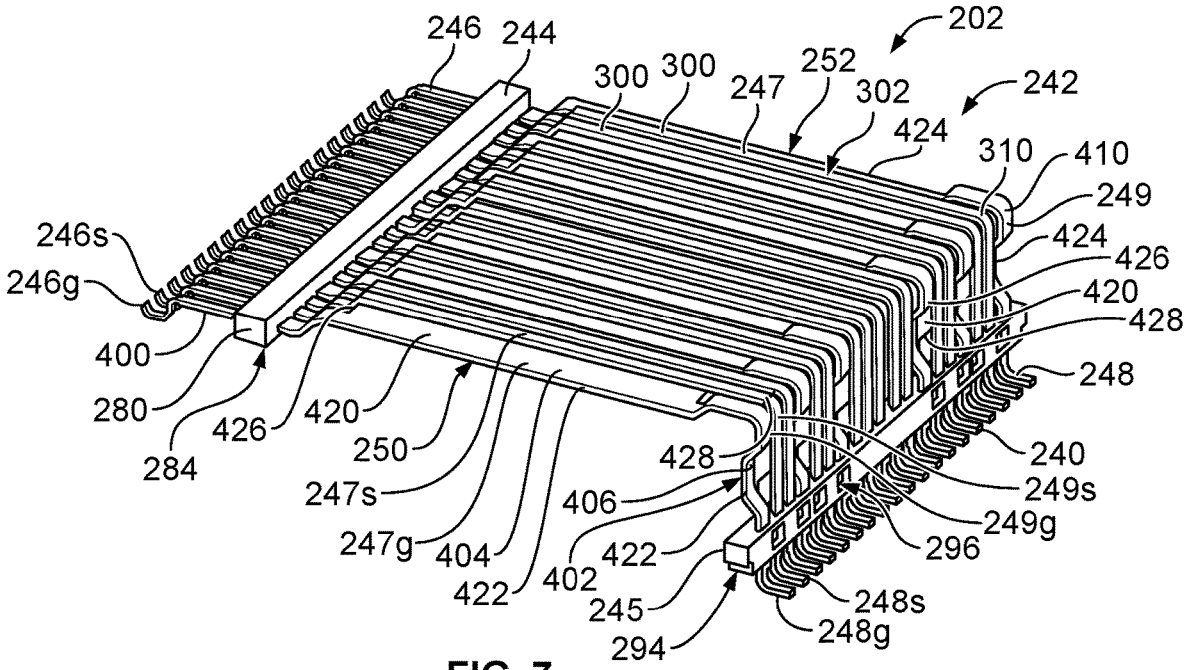
FIG. 7 is a rear perspective view of the first upper contact array in accordance with an exemplary embodiment.
Figure 8:
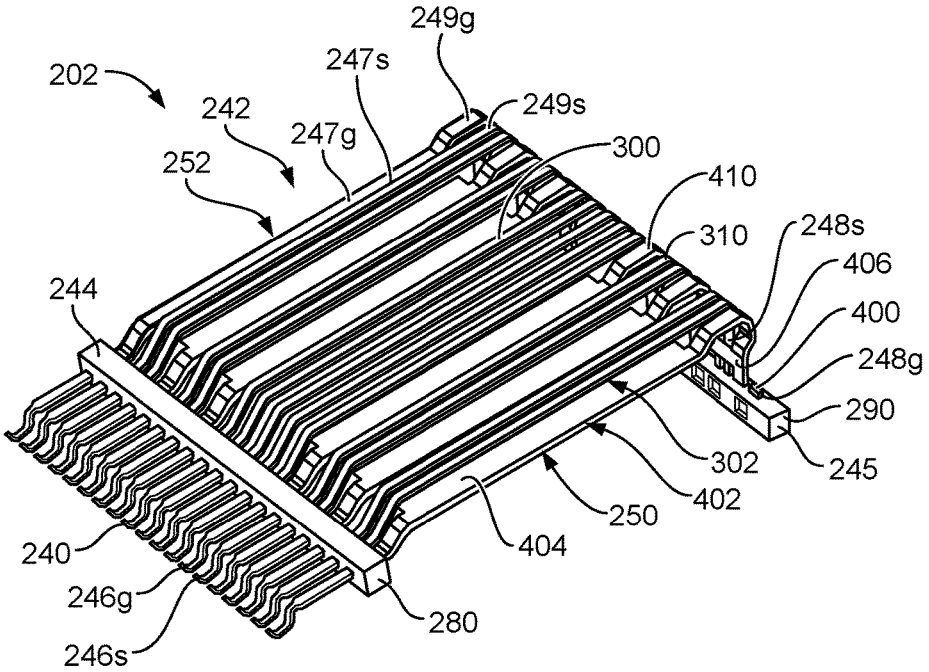
FIG. 8 is a front perspective view of the first upper contact array in accordance with an exemplary embodiment.
Figure 9:
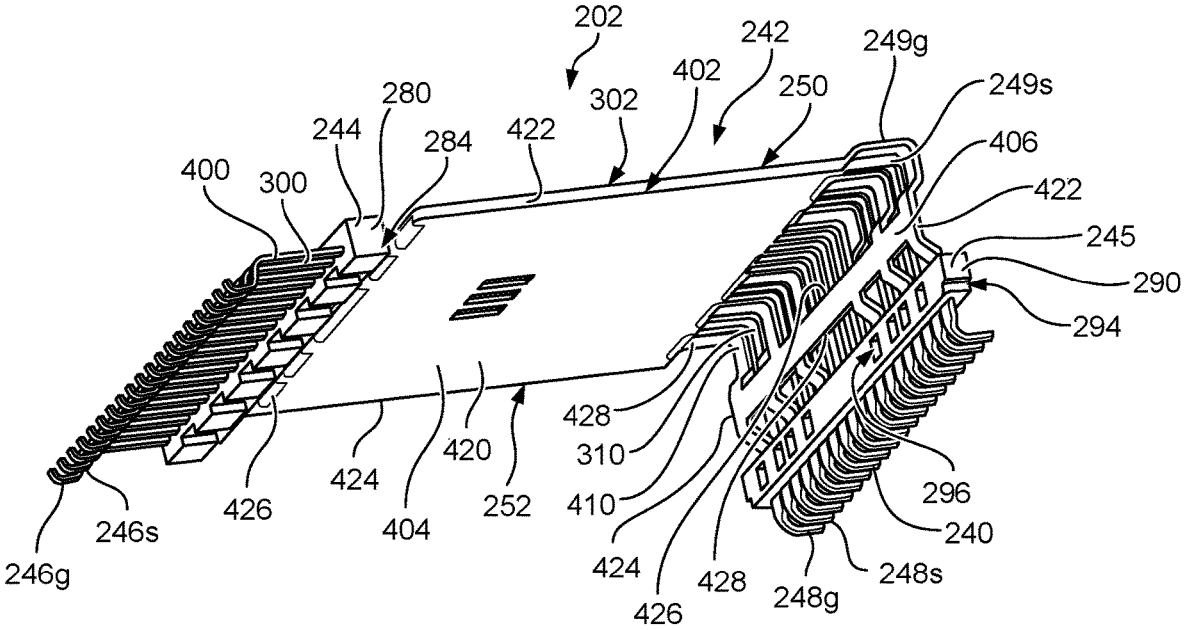
FIG. 9 is a bottom perspective view of the first upper contact array in accordance with an exemplary embodiment.

FIG. 7 is a rear perspective view of the first upper contact array 242 in accordance with an exemplary embodiment. FIG. 8 is a front perspective view of the first upper contact array 242 in accordance with an exemplary embodiment. FIG. 9 is a bottom perspective view of the first upper contact array 242 in accordance with an exemplary embodiment. The first upper contact array 242 is exemplary of the contact arrays of the contact assembly 202 (for example, the second upper contact array 243 and/or the first lower contact array 262 and/or the second lower contact array 263 all shown in FIG. 4 may include similar components and may not be described in the same amount of detail).

The upper contacts 240 are held by the front contact holder 244 and the rear contact holder 245. The mating beams 246 extend forward of the front contact holder 244. The transition portions 247 extend between the front contact holder 244 and the rear contact holder 245. The contact tails 248 extend from the rear contact holder 245, such as from the bottom of the rear contact holder 245.

In various embodiments, the front contact holder 244 includes a dielectric body 280 overmolded around the upper contacts 240 to encase the upper contacts 240. In an exemplary embodiment, the front contact holder 244 includes locating features 284 for locating the front contact holder 244 in the contact positioner 230 (FIG. 6). In various embodiments, the rear contact holder 245 includes a dielectric body 290 overmolded around the upper contacts 240 to encase the upper contacts 240. In an exemplary embodiment, the rear contact holder 245 includes locating features 294 for locating the rear contact holder 245 in the contact positioner 230. In various embodiments, the front contact holder 244 and/or the rear contact holder 245 may include impedance control windows 296 for controlling impedance of the signals transmitted along the signal contacts 300. The impedance control windows 296 may expose the signal contacts 300 to air.

The ground bus bridges 404, 406 extends between each of the upper ground contacts 400 to electrically common each of the upper ground contacts 400. The upper ground contacts 400 are electrically connected to the ground bus bridges 404, 406 without an interface (for example, no solder interface, weld interface or conductive adhesive interface). Rather, the ground bus bridges 404, 406 are integral with the upper ground contacts 400. For example, the ground bus bridges 404, 406 and the upper ground contacts 400 are stamped and formed from the same sheet of metal. In an exemplary embodiment, each ground bus bridge 404, 406 includes a plate 420 extending between a first side 422 and a second side 424. The plate 420 includes edges 426, 428 between the first and second sides 422, 424. The ground mating beams 246*g* extend from the edge of the ground bus bridge 404. The ground contact tails 248*g* extend from the edge of the ground bus bridge 406. The ground intermediate portions 249*g* extend between the edge 428 of the ground bus bridge 404 and the edge 426 of the ground bus bridge 406.

The ground bus bridges 404, 406 extend across the signal intermediate portions 249*s* of the upper signal contacts 300. The signal intermediate portions 249 extend generally parallel to and spaced apart from the ground bus bridges 404, 406. The ground bus bridges 404, 406 extend an entire width of the contact assembly 202 between a first side 250 and a second side 252 of the contact assembly 202. In the illustrated embodiment, the ground bus bridge 404 is located below the signal intermediate portions 249 and the ground bus bridge 406 is located forward of the signal intermediate portions 249. Other locations are possible in alternative embodiments. The ground bus bridges 404, 406 are spaced apart from the signal intermediate portions 249 by small air gaps to prevent short circuiting. However, the ground bus bridges 404, 406 are in close proximity to the signal intermediate portions 249*s* for resonance control of signals transmitted along the upper signal contacts 300.

The signal contacts 300 and the ground contacts 400 are held together by the front and rear contact holders 244, 245. In an exemplary embodiment, the signal leadframe 302 and the ground leadframe 402 are overmolded by the front and rear contact holders 244, 245 to hold the relative positions of the signal leadframe 302 and the ground leadframe 402. In an exemplary embodiment, the upper ground mating beams 246*g* are interspersed between the upper signal mating beams 246*s*, the upper ground contact tails 248*g* are interspersed between the upper signal contact tails 248*s*, and the upper ground intermediate portions 249*g* are interspersed between the upper signal intermediate portions 249*s*. The ground bus bridges 404, 406 are transitioned out of plane relative to the corresponding upper signal intermediate portions 249*s* (for example, above/below or rearward/forward). The ground bus bridges 404, 406 extend parallel to the corresponding upper signal intermediate portions 249*s*. In an exemplary embodiment, the front ground bus bridge 404 is a horizontal ground bus bridge and the rear ground bus bridge 406 is a vertical ground bus bridge.

In an exemplary embodiment, the upper signal intermediate portions 249*s* and the upper ground intermediate portions 249*g* are bent at corners 310, 410 to transition between the upper signal mating beams 246*s* and the upper signal contact tails 248*s* and between the upper ground mating beams 246*g* and the upper ground contact tails 248*g*, respectively. The ground bus bridge 404 is located forward of the corners 410, such as between the corners 410 and the upper ground mating beams 246*g*. The ground bus bridge 406 is located below the corners 410, such as between the corners 410 and the upper ground contact tails 248*g*. In an exemplary embodiment, the upper signal intermediate portions 249*s* and the upper ground intermediate portions 249*g* are bent at the corners 310, 410 after the upper front contact holder 244 and the upper rear contact holder 245 are coupled to the upper signal contacts 300 and the upper ground contacts 400 to maintain relative positions of the upper signal contacts 300 and the upper ground contacts 400 after the upper signal intermediate portions 249*s* and the upper ground intermediate portions 249*g* are bent at the corners 310, 410.

Figure 10:
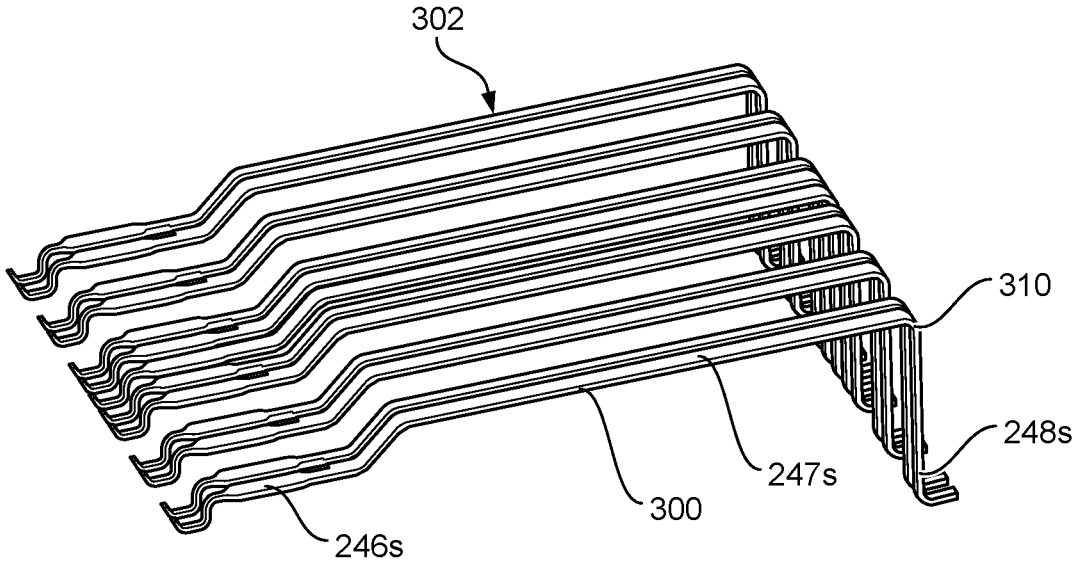
FIG. 10 is a perspective view of the signal leadframe in accordance with an exemplary embodiment.

FIG. 10 is a perspective view of the signal leadframe 302. The signal leadframe 302 includes the signal contacts 300. Each signal contact 300 includes the signal transition portion 247*s* extending between the signal mating beam 246*s* and the signal contact tail 248*s*. In an exemplary embodiment, the signal contacts 300 include high speed signal contacts and low speed signal contacts. In the illustrated embodiment, the low speed signal contacts are grouped together in the center of the signal contact array. In the illustrated embodiment, the high speed signal contacts are arranged in pairs, such as four pairs. The pairs may be transmit pairs and receive pairs. The signal contacts 300 in the pairs are spaced tightly together and spaced apart from other pairs by larger gaps or spaces, which may receive ground contacts 400 (shown in FIG. 11). In an exemplary embodiment, the signal contacts 300 are right-angle contacts having a right-angle or 90° bend at the corners 310. The signal contacts 300 may be generally horizontal forward of the corners 310 and generally vertical below the corner 310.

Figure 11:
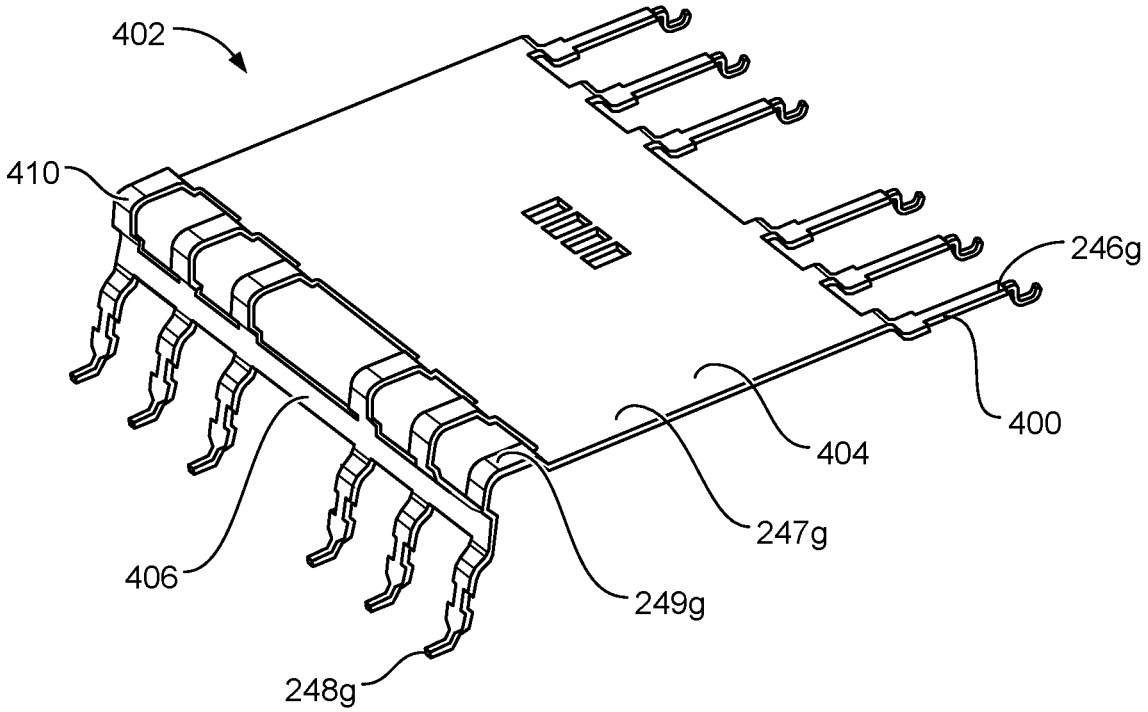
FIG. 11 is a perspective view of the ground leadframe 402 in accordance with an exemplary embodiment.

FIG. 11 is a perspective view of the ground leadframe 402.

The ground leadframe 402 includes the ground contacts 400 and the ground bus bridges 404, 406. The ground bus bridges 404, 406 are integral with the upper ground contacts 400. For example, the ground bus bridges 404, 406 and the upper ground contacts 400 are stamped and formed from the same sheet of metal. The ground transition portion 247*g* include the ground bus bridges 404, 406 and the ground intermediate portions 249*g*. The ground mating beam 246*g* extend forward from the ground transition portions 247*g* at the front and top of the ground leadframe 402 and the ground contact tail 248*g* extend from the ground transition portion 247*g* at the bottom and rear of the ground leadframe 402. In an exemplary embodiment, the ground mating beams 246*g* are configured to be interspersed between the signal mating beams 246*s*, such as between the pairs of signal contacts 300. The ground contact tails 248*g* are configured to be interspersed between the signal contact tails 248*s*, such as between the pairs of signal contacts 300. The ground intermediate portions 249*g* are configured to be interspersed between the signal intermediate portions 249*s*, such as between the pairs of signal contacts 300. In an exemplary embodiment, the ground contacts 400 are right-angle contacts having a right-angle or 90° bend at the corners 410. The ground contacts 400 may be generally horizontal forward of the corners 410 and generally vertical below the corner 410.

Figure 12:
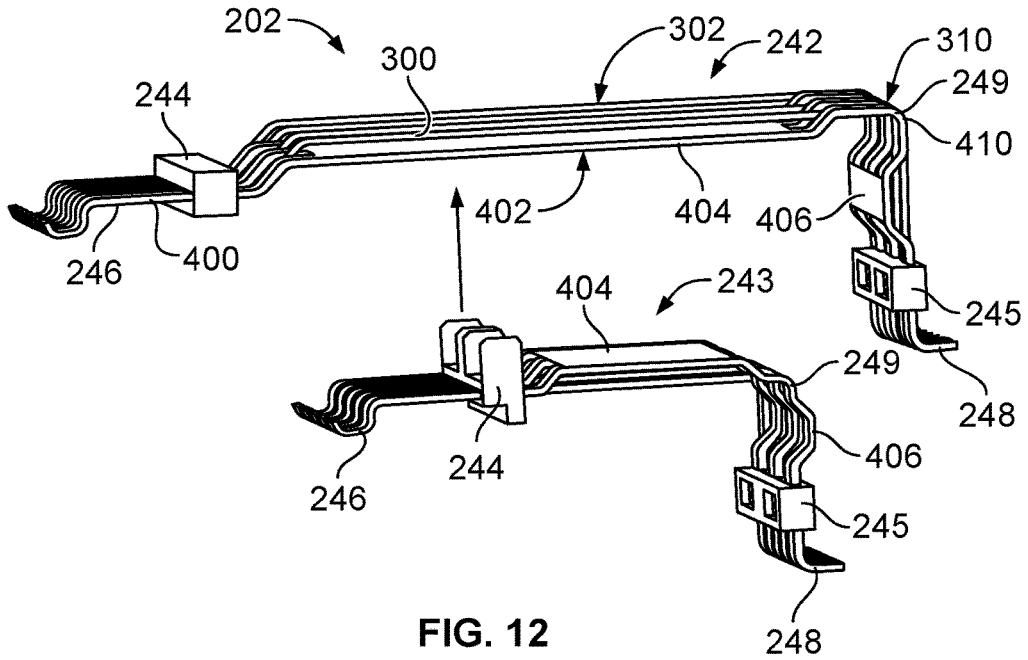
FIG. 12 is an exploded, side view of a portion of the contact assembly showing the first upper contact array and the second upper contact array in accordance with an exemplary embodiment.

FIG. 12 is an exploded, side view of a portion of the contact assembly 202 showing the first upper contact array 242 and the second upper contact array 243. The front and rear contact holders 244, 245 are overmolded over the signal and ground leadframes 302, 402 of the first and second upper contact arrays 242, 243. The signal leadframe 302 and the ground leadframe 402 may be bent at the corners 310, 410 after the front and rear contact holders 244, 245 are overmolded. As such, the mating beams 246 and the contact tails 248 are held in place by the contact holders 244, 245 while the intermediate portions 249 are bent. The contact holders 244, 245 hold the signal contacts 300 such that the signal intermediate portions 249*s* extend generally parallel to and spaced apart from the ground bus bridges 404, 406. The ground bus bridges 404, 406 are transitioned out of plane relative to the signal intermediate portions 249*s*. For example, the in an exemplary embodiment, the first and second upper contact arrays 242, 243 may be assembled together, such as by coupling the front contact holder 244 of the second upper contact array 243 to the first upper contact array 242, such as to the first ground leadframe 402 of the first upper contact array 242. In the illustrated embodiment, the front contact holder 244 of the second upper contact array 243 includes fins at the top that are loaded into openings in the first ground leadframe 402 to position the first upper contact array 242 relative to the second upper contact array 243. The first and second rear contact holders 245 may be coupled together. In an exemplary embodiment, the forward ground bus bridges 404 and the rear ground bus bridges 406 are transitioned toward each other. Optionally, the forward ground bus bridges 404 may be coupled together and/or the rear ground bus bridges 406 may be coupled together.

Figure 13:
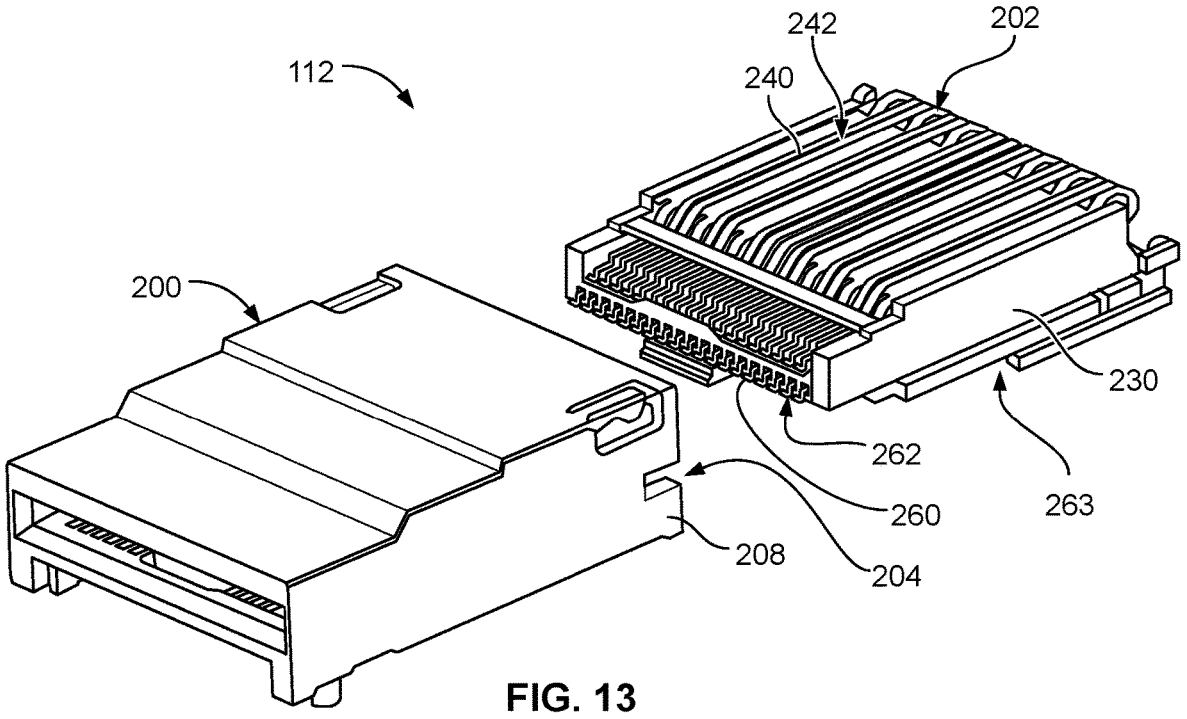
FIG. 13 is a front perspective view of the card edge connector showing the contact assembly being loaded into the outer housing in accordance with an exemplary embodiment.

FIG. 13 is a front perspective view of the card edge connector 112 showing the contact assembly 202 being loaded into the outer housing 200. The upper contact arrays 242, 243 and the lower contact arrays 262, 263 are assembled with the contact positioner 230. The contact positioner 230 supports the upper contacts 240 and the lower contacts 260. The contact positioner 230 is configured to be loaded into the cavity 204 through the rear 208 of the outer housing 200.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contact assembly for an electrical connector comprising:

a contact array having contacts including signal contacts and ground contacts, the signal contacts include signal intermediate portions extending between signal mating beams configured to mate with mating contacts and signal contact tails configured to be mounted to a host circuit board, the ground contacts include ground intermediate portions extending between ground mating beams configured to mate with mating contacts and ground contact tails configured to be mounted to the host circuit board;

a front contact holder holding the signal mating beams and the ground mating beams and a rear contact holder separate and discrete from the front contact holder holding the signal contact tails and the ground contact tails; and a ground bus bridge extending between each of the ground contacts to electrically common each of the ground contacts, the ground bus bridge being integral with the ground contacts, the ground bus bridge including a plate at the ground intermediate portions, the plate of the ground bus bridge extending across the signal intermediate portions parallel to and spaced apart from the signal intermediate portions and in close proximity to the signal intermediate portions for resonance control of signals transmitted along the signal contacts.

2. The contact assembly of claim 1, wherein the ground mating beams extend forward from a front edge of the plate of the ground bus bridge.

3. The contact assembly of claim 1, wherein the contact array includes a signal leadframe and a ground leadframe, the signal contacts formed by the signal leadframe, the ground contacts and the ground bus bridge being formed by the ground leadframe.

4. The contact assembly of claim 1, wherein the ground contacts are electrically connected to the ground bus bridge without an interface.

5. The contact assembly of claim 1, wherein the ground mating beams are interspersed between the signal mating beams, wherein the ground contact tails are interspersed between the signal contact tails, wherein the ground intermediate portions are interspersed between the signal intermediate portions, and wherein the ground bus bridge is transitioned out of plane and parallel to the signal intermediate portions.

6. The contact assembly of claim 1, wherein the ground intermediate portions and the signal intermediate portions are bent at corners to transition between the ground mating beams and the ground contact tails and between the signal mating beams and the signal contact tails, respectively, the ground bus bridge located forward of the corners between the corners and the ground mating beams.

7. The contact assembly of claim 6, further comprising a rear ground bus bridge located between the corners and the ground contact tails, the rear ground bus bridge extending between each of the ground contacts to electrically common each of the ground contacts, the rear ground bus bridge being integral with the ground contacts, the rear ground bus bridge extending across the signal intermediate portions in close proximity to the signal intermediate portions for resonance control of signals transmitted along the signal contacts.

8. The contact assembly of claim 7, wherein the ground bus bridge is a horizontal ground bus bridge and the rear ground bus bridge is a vertical ground bus bridge.

9. The contact assembly of claim 6, wherein the ground intermediate portions and the signal intermediate portions are bent at the corners after the front contact holder and the rear contact holder are coupled to the signal contacts and the ground contacts to maintain relative positions of the signal contacts and the ground contacts after the ground intermediate portions and the signal intermediate portions are bent at the corners.

10. The contact assembly of claim 1, wherein the ground bus bridge extends an entire width of the contact assembly between a first side and a second side of the contact assembly.

11. The contact assembly of claim 1, wherein the contact array is a first upper contact array of an upper contact array, the upper contact array further comprising a second upper contact array; the contact assembly further comprising a lower contact array, wherein the upper contact array and the lower contact array are held by a contact positioner to receive a card edge of a circuit card therebetween, wherein the signal contacts and the ground contacts of the first upper contact array define first upper contacts, the front contact holder defining a first upper front contact holder, and the rear contact holder defining a first upper rear contact holder, the first upper rear contact holder being separate and discrete from the first upper front contact holder, the signal intermediate portions and the ground intermediate portions defining first upper intermediate portions, the signal mating beams and the ground mating beams defining first upper mating beams, and the signal contact tails and the ground contact tails defining first upper contact tails, the first upper mating beams extending from the first upper front contact holder and arranged in a first upper row to mate with first upper mating contacts of the circuit card, the first upper contact tails extending from the first upper rear contact holder for mounting to a host circuit board, the first upper contacts including first upper signal contacts and first upper ground contacts, the ground bus bridge defining a first upper ground bus bridge extending between each of the first upper ground contacts to electrically common each of the first upper ground contacts, the first upper ground bus bridge being integral with the first upper ground contacts, the first upper ground bus bridge including a first upper plate at the first upper intermediate portions of the first upper ground contacts, the first upper plate of the first upper ground bus bridge extending across the first upper intermediate portions of the first upper signal contacts parallel to and spaced apart from the first upper intermediate portions of the first upper signal contacts and in close proximity to the first upper intermediate portions of the first upper signal contacts for resonance control of signals transmitted along the first upper signal contacts; and wherein the second upper contact array includes second upper contacts, a second upper front contact holder, and a second upper rear contact holder, the second upper rear contact holder being separate and discrete from the second upper front contact holder, the second upper contacts including second upper intermediate portions extending between second upper mating beams and second upper contact tails, the second upper mating beams extending from the second upper front contact holder and arranged in a second upper row to mate with second upper mating contacts of the circuit card, the second upper contact tails extending from the second upper rear contact holder for mounting to the host circuit board, the second upper contacts including second upper signal contacts and second upper ground contacts, the second upper contact array including a second upper ground bus bridge extending between each of the second upper ground contacts to electrically common each of the second upper ground contacts, the second upper ground bus bridge being integral with the second upper ground contacts, the second upper ground bus bridge including a second upper plate at the second upper intermediate portions of the second upper ground contacts, the second upper plate of the second upper ground bus bridge extending across the second upper intermediate portions of the second upper signal contacts parallel to and spaced apart from the second upper intermediate portions of the second upper signal contacts and in close proximity to the second upper intermediate portions of the second upper signal contacts for resonance control of signals transmitted along the second upper signal contacts.

12. The contact assembly of claim 11, wherein the first upper contact array includes a first upper signal leadframe and a first upper ground leadframe, the first upper signal contacts formed by the first upper signal leadframe, the first upper ground contacts and the first ground bus bridge being formed by the first upper ground leadframe, and wherein the second upper contact array includes a second upper signal leadframe and a second upper ground leadframe, the second upper signal contacts formed by the second upper signal leadframe, the second upper ground contacts and the second ground bus bridge being formed by the second upper ground leadframe.

13. The contact assembly of claim 11, wherein the first upper mating beams of the first upper ground contacts are interspersed between the first upper mating beams of the first upper signal contacts, wherein the first upper contact tails of the first upper ground contacts are interspersed between the first upper contact tails of the first upper signal contacts, wherein the first upper intermediate portions of the first upper ground contacts are interspersed between the first upper intermediate portions of the first upper signal contacts, and wherein the first upper ground bus bridge is transitioned out of plane and parallel to the first upper intermediate portions of the first upper signal contacts, and wherein the second upper mating beams of the second upper ground contacts are interspersed between the second upper mating beams of the second upper signal contacts, wherein the second upper contact tails of the second upper ground contacts are interspersed between the second upper contact tails of the second upper signal contacts, wherein the second upper intermediate portions of the second upper ground contacts are interspersed between the second upper intermediate portions of the second upper signal contacts, and wherein the second upper ground bus bridge is transitioned out of plane and parallel to the second upper intermediate portions of the second upper signal contacts.

14. The contact assembly of claim 11, wherein the first upper intermediate portions are bent at first corners to transition between the first upper mating beams and the first upper contact tails, the first upper ground bus bridge being located forward of the first corners between the first corners and the first upper mating beams, and wherein the second upper intermediate portions are bent at second corners to transition between the second upper mating beams and the second upper contact tails, the second upper ground bus bridge being located forward of the second corners between the second corners and the second upper mating beams.

15. The contact assembly of claim 14, further comprising a first upper rear ground bus bridge located between the first corners and the first upper contact tails, the first upper rear ground bus bridge extending between each of the first upper ground contacts to electrically common each of the first upper ground contacts, the first rear ground bus bridge being integral with the first upper ground contacts, the first rear ground bus bridge extending across the first upper intermediate portions of the first upper signal contacts in close proximity to the first upper intermediate portions of the first upper signal contacts for resonance control of signals transmitted along the first upper signal contacts, and further comprising a second upper rear ground bus bridge located between the second corners and the second upper contact tails, the second upper rear ground bus bridge extending between each of the second upper ground contacts to electrically common each of the second upper ground contacts, the second upper rear ground bus bridge being integral with the second upper ground contacts, the second upper rear ground bus bridge extending across the second upper intermediate portions of the second upper signal contacts in close proximity to the second upper intermediate portions of the second upper signal contacts for resonance control of signals transmitted along the upper signal contacts.

16. The contact assembly of claim 15, wherein the first upper ground bus bridge is a horizontal ground bus bridge and the first upper rear ground bus bridge is a vertical ground bus bridge, and wherein the second upper ground bus bridge is a horizontal ground bus bridge and the second upper rear ground bus bridge is a vertical ground bus bridge.

17. The contact assembly of claim 14, wherein the first upper intermediate portions are bent at the first corners after the first upper front contact holder and the first upper rear contact holder are coupled to the first upper signal contacts and the first upper ground contacts to maintain relative positions of the first upper signal contacts and the first upper ground contacts after the first upper ground intermediate portions are bent at the first corners, and wherein the second upper intermediate portions are bent at the second corners after the second upper front contact holder and the second upper rear contact holder are coupled to the second upper signal contacts and the second upper ground contacts to maintain relative positions of the second upper signal contacts and the second upper ground contacts after the second upper ground intermediate portions are bent at the second corners.

18. The contact assembly of claim 11, wherein the first upper ground bus bridge extends an entire width of the first upper contact array between opposite sides of the first upper contact array, and wherein the second upper ground bus bridge extends an entire width of the second upper contact array between opposite sides of the second upper contact assembly.

* * * * *